United States Patent [19]

Behnke

[11] 4,013,334

[45] Mar. 22, 1977

[54] DIAGNOSTIC APPARATUS

[75] Inventor: Horst Behnke, Esslingen, Germany

[73] Assignee: Daimler-Benz Aktiengesellschaft, Germany

[22] Filed: June 9, 1975

[21] Appl. No.: 584,726

[30] Foreign Application Priority Data

June 14, 1974 Germany ..... 2428761

[52] U.S. Cl. ..... 339/113 R; 324/15

[51] Int. Cl.[2] ..... H01R 3/00

[58] Field of Search ..... 339/113 R, 111, 46, 339/31–33; 324/15, 16 R, 16 S

[56] References Cited

UNITED STATES PATENTS

| | | | |
|---|---|---|---|
| 3,024,438 | 3/1962 | Trush | 339/31 T X |
| 3,634,752 | 1/1972 | Willing | 324/15 |

*Primary Examiner*—Roy Lake
*Assistant Examiner*—DeWalden W. Jones
*Attorney, Agent, or Firm*—Craig & Antonelli

[57] ABSTRACT

A diagnostic apparatus, especially for measuring the ignition voltage development in motor vehicles, which is equipped with two measurement value pick-up devices whereby each pick-up device is constructed as adaptor plug while the two pick-up devices are movable relative to one another by means of a connecting member.

20 Claims, 3 Drawing Figures

DIAGNOSTIC APPARATUS

The present invention relates to a diagnostic apparatus, especially for measuring the ignition voltage curve and for the cylinder characterization of ignition systems in motor vehicles, with at least two measurement value pick-up devices or transducers.

Diagnostic apparatus and measurement value pick-up devices rigidly connected therewith have been well-known in the art for some time. The measurement value pick-up devices used thereby which operate predominantly inductively or capacitively, are either quite expensive—for example, with a construction in the manner of current tongs, or are quite complicated and time-consuming to install which is the case in particular with the use of several measurement value pick-up devices or transducers. For that reason, measurement value pick-up devices also are securely installed into the vehicle and are provided with plug-in sockets in order to be able to rapidly connect the diagnostic apparatus. However, also this method is very expensive since each vehicle has to be equipped with such an installation.

It is the aim of the present invention to provide a diagnostic apparatus which avoids the aforementioned disadvantages and nonetheless can be rapidly interconnected.

The underlying problems are solved according to the present invention in that each measurement value pick-up is constructed as adaptor plug and that the measurement value pick-up devices are displaceable relative to one another by way of a connecting member.

In one embodiment according to the present invention, provision is made that the connecting member is constructed as slide frame, with which one measurement value pick-up device is rigidly connected and in which the other measurement value pick-up device is displaceable. In another embodiment, provision is made that the connecting member is constructed as pivotal member whose two leg ends are each rigidly connected with one respective measurement pick-up device. Additionally, provision is made that the connecting member includes detent positions for standardized connecting distances.

Furthermore, provision is made according to the present invention that the displaceable measurement value pick-up device is equipped with a tongue-like extension and that symbols which indicate the apparatus constructions having the standardized connecting distances, are so arranged on the tongue-like extension or on one leg of the pivotal connecting member that they appear in a window or at a marking of the slide frame or of the other leg, when the measurement value pick-up devices have the coordinated distance from one another. This is of advantage especially with standardized ignition distributors where the distance of the center electrode to the outer electrodes is directly coordinated to the number of cylinders of the engine.

For the safe transmission of the measurement values to the diagnostic apparatus, provision is made that an adaptation member accommodated in the adaptor plug housing is connected in the output of the measurement value pick-up and that the measurement value pick-up includes an electrically conductive shielding which is electrically connected with the shielding of the apparatus to be measured and/or of the feed-in cable.

For the better manipulation and protection of the apparatus, provision is made appropriately that the connecting member is provided with a handle for the purpose of installing the connecting contacts in a manner as free from canting or tilting as possible and contains simultaneously the connecting line to the diagnostic apparatus.

Accordingly, it is an object of the present invention to provide a diagnostic apparatus which avoids by simple means the aforementioned shortcomings and drawbacks encountered in the prior art.

Another object of the present invention resides in a diagnostic apparatus for motor vehicles, especially for measuring the ignition voltage curve and the cylinder characterization of ignition systems in motor vehicles, which is relatively simple in construction, involves relatively small expenditures and enables a rapid installation and connection.

Still a further object of the present invention resides in a diagnostic apparatus which can be rapidly connected with the equipment in case of need.

Another object of the present invention resides in a diagnostic apparatus which assures a reliable transmission of the measurement values while at the same time protecting the apparatus.

These and other objects, features, and advantages of the present invention will become more apparent from the following description when taken in connection with the accompanying drawing which shows, for purposes of illustration only, two embodiments in accordance with the present invention, and wherein.

Figure 1:
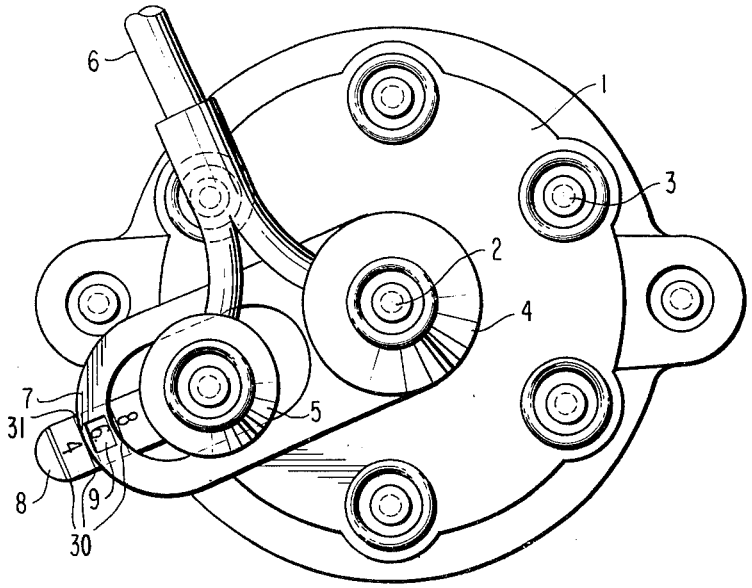
FIG. 1 is a plan view of one embodiment of a diagnostic apparatus for the ignition voltage analysis in motor vehicle engines in accordance with the present invention equipped with a sliding frame.
Figure 2:
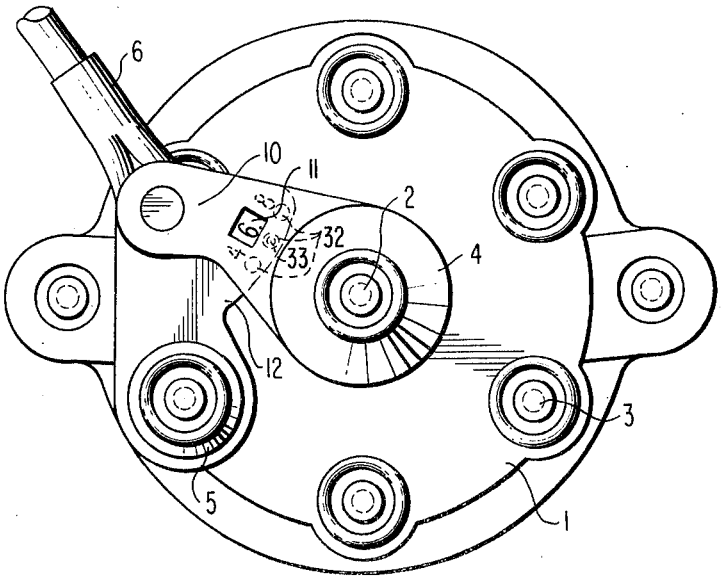
FIG. 2 is a plan view on a modified embodiment of a diagnostic apparatus for the ignition voltage analysis in motor vehicle engines in accordance with the present invention provided with a joint member.

Referring now to the drawing and more particularly to FIGS. 1 and 2, these two figures illustrate each a plan view on the ignition distributor cap 1 of a six-cylinder engine with the high voltage connections 2 from the ignition coil to the ignition distributor and the six high voltage connections 3 arranged ring-shaped about the high voltage connection and leading from the ignition distributor to the spark plugs (not shown) of the individual cylinders.

A measurement value pick-up device 4 of conventional construction is required for the analysis of the ignition voltage development at the spark plug while a further measurement value pick-up device 5 again of conventional construction is required for the determination of the ignition instant at each cylinder and characterization or identication of the cylinders and for triggering the oscillograph. FIG. 1 illustrates these two measurement value pick-ups 4 and 5, plugged-in on the correspondin g high voltage connections of the ignition distributor. A feed-in cable 6 leads to the diagnostic apparatus (not shown) which is of conventional construction and therefore not illustrated in detail. A slide frame 7 is rigidly connected with the measurement value pick-up 4, in which the measurement value pick-up 5 is displaceably supported. Rigidly connected with the measurement value pick-up is a tongue-like extension 8, on which are engraved the numbers 4, 6, and 8, of which one appears respectively in a window 9 of the slide frame 7 when the measurement value pick-up devices are plugged-in over the high voltage connections of standardized ignition distributors of four-, six-, or eight-cylinder engines. In these positions, the measurement value pick-up device 5 enagages in detents or the like provided in the slide frame 7 which is not illustrated in detail and shown generally as cooperating detents 30, 31 since it is of conventional construction.

FIG. 2 illustrates another embodiment according to the present invention with the same functions as in FIG. 1 and with the same arrangement of the measurement value pick-ups 4 and 5, whose connection is formed by a joint or pivotal member 10, in whose one leg is disposed a window 11, in which appear the numbers engraved on the extension 12 connected with the other leg when the detent arrangement shown generally at 32, 33 are in engagement.

Figure 3:
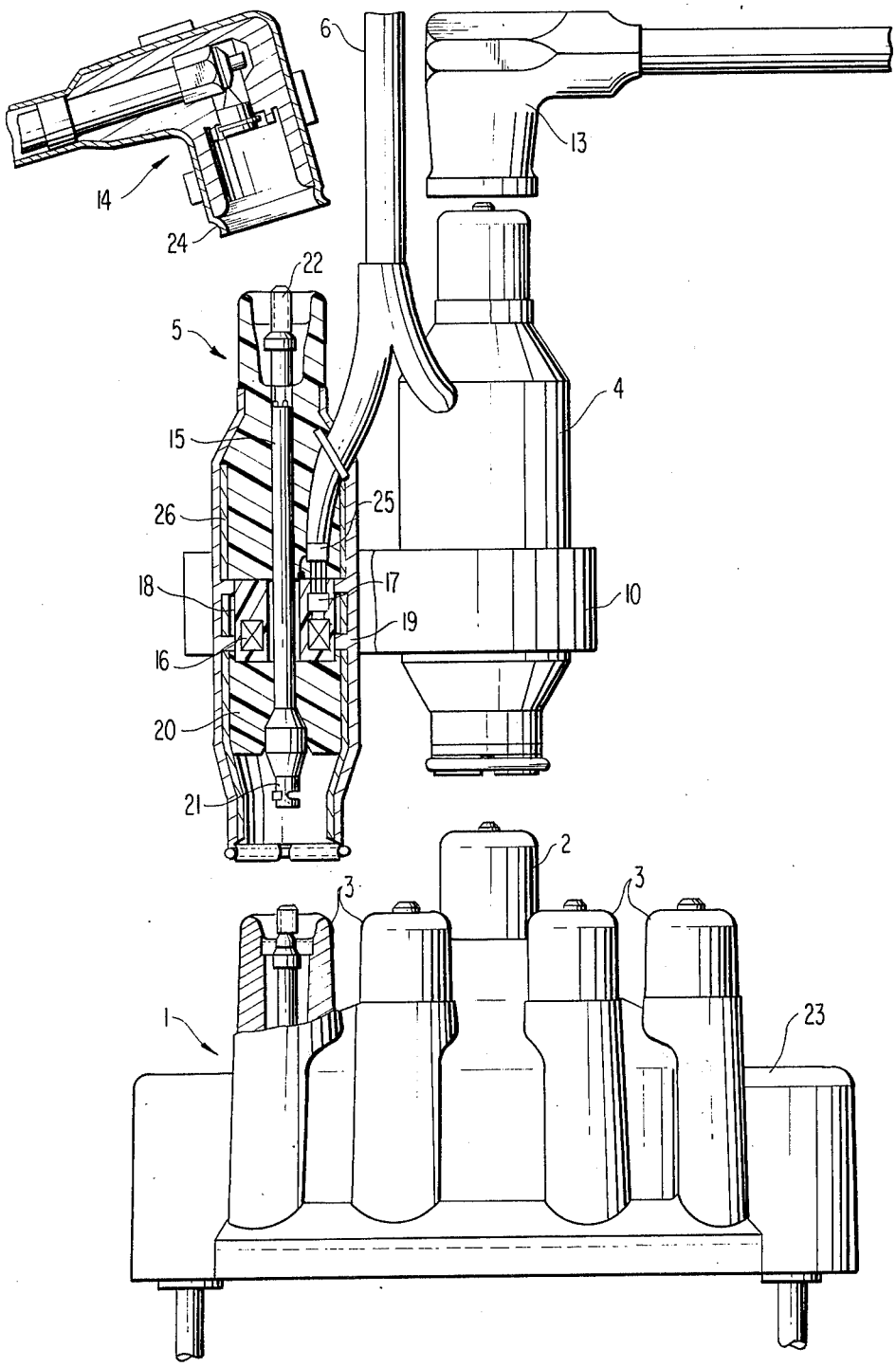
FIG. 3 is an elevational view, partly in cross section, of a diagnostic apparatus in accordance with the present invention.

The construction of the measurement value pick-up devices as adaptor plugs and the arrangement thereof between distributor and ignition cables are illustrated in FIG. 3—in cross section insofar as necessary. The ignition distributor cap 1 is illustrated in this case in side view, which includes the high voltage connection 2, on which is normally seated the plug 13 of the connecting line leading to the ignition coil, and the high voltage connections 3 arranged ring-shaped about the high voltage connection 2, of which one is shown partly in cross section and on which are normally seated the ignition cable plugs 14, of which only one is shown in cross section.

For the purpose of ignition analysis, the plug 13 and one of the plugs 14—preferably the one belonging to cylinder number one—are pulled off, whereupon the measurement value pick-up devices 4 and 5 connected with each other by a connecting member 7 (FIG. 1) or 10 (FIG. 2) are mounted on the high-voltage connection 2 and on the corresponding high voltage connection 3 by being plugged into the same, and then the plugs 13 and 14 are again installed by being plugged-in on the pick-up devices 4 and 5.

The measurement value pick-up 5 is illustrated in cross section in FIG. 3. The measurement coil 16 is arranged about the central lead-through conductor 15 and together with an integrated matching amplifier 17 is accommodated in a shielding cup 18. The shielding cup 18 serves, inter alia, the purpose to keep away any high-voltage arcs caused by spark-over voltages which might possibly occur, from the measurement coil 16 and therewith from the diagnostic apparatus. The entire arrangement is disposed in a tubular shielding member 19 consisting of an electrically conductive material and as also the shielding cup 18 itself is so cast together with synthetic resinous material 20 or similar insulating material that the ends of the central lead-through conductor 15 constructed as bush 21 and plug 22 project therefrom and that the tubular shielding member 19 projects so far on the bush side that it represents a protection for the bush 21 and simultaneously forms a springy connection with the shield 23 of the ignition distributor cap 1 when being plugged-in. On the other side, the tubular shielding member 19 is drawn up along the cast body 20 so far that when the ignition cable plug 14 is plugged-in, the elastic shield 24 thereof is able to slide over the same. The feed-in cable 6 which is also shielded, and whose shield is connected with the shielding cup 18 and by way of the latter with the tubular shielding member 19, connects the measurement coil 16 and the integrated matching amplifier 17 with the diagnostic apparatus. The inner side of the tubular shielding member 19 is provided with a synthetic resinous material or rubber layer against entry of moisture, which closes off the plug connection in a water-tight manner when the measurement value pick-up is plugged-in. The measurement value pick-up which is not shown in cross section is also constructed like the measurement value pick-up 5.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A diagnostic apparatus with at least two pick-up means for picking up measurement values, characterized in that each pick-up means is constructed as an adaptor plug means for establishing a path between at least two parts to be connected, and in that a connecting means is provided for connecting the pick-up means together while enabling the pick-up means to be movable relative to one another.

2. A diagnostic apparatus according to claim 1, characterized in that the connecting means include a connecting member for enabling the two pick-up means to be displaceable relative to one another.

3. A diagnostic apparatus according to claim 1, characterized in that the diagnostic apparatus is for measuring the ignition voltage development and for cylinder characterization of ignition systems in motor vehicles, the pick-up means being coupled to the ignition system.

4. A diagnostic apparatus according to claim 1, characterized in that the connecting means is constructed as a slide frame rigidly connected with one pick-up means, the other pick-up means being slidable within the slide-frame.

5. A diagnostic apparatus according to claim 1, characterized in that the connecting means is constructed as a joint member with two legs, the two leg ends being respectively rigidly connected with a corresponding pick-up means.

6. A diagnostic apparatus according to claim 1, characterized in that the connecting means includes detent means for standardized connecting distances.

7. A diagnostic apparatus according to claim 1, characterized in that the movable pick-up means includes a tongue-like extension, and in that symbols which indicate the apparatus constructions having standardized connecting distances, are so arranged on one of the two parts consisting of the extension and the connecting means that the symbols become visible when the pick-up means are disposed at respective standardized connecting distances from one another.

8. A diagnostic apparatus with an adaptor plug housing means according to claim 1, characterized in that a matching means accommodated in the adaptor plug housing means is connected in the output of the pick-up means.

9. A diagnostic apparatus with a feed cable according to claim 1, characterized in that the pick-up means includes an electrically conductive shield means which is electrically connected with the shield means of at least one of the two parts consisting of an apparatus to be measured and a feed cable.

10. A diagnostic apparatus according to claim 9, characterized in that the electrically conductive shield means is electrically connected with both the apparatus to be measured and the feed-in cable.

11. A diagnostic apparatus according to claim 1, characterized in that the connecting means includes a handle means for plugging-in connecting contacts in a relatively tilting-free manner and simultaneously contains connecting lines to the diagnostic apparatus.

12. A diagnostic apparatus according to claim 4, characterized in that the movable pick-up means includes a tongue-like extension, and in that symbols which indicate the apparatus constructions having standardized connecting distances, are so arranged on the extension that the symbols become visible when the pick-up means are disposed at respective standardized connecting distances from one another.

13. A diagnostic apparatus according to claim 12, characterized in that the symbols appear in a window of the slide frame.

14. A diagnostic apparatus according to claim 13, characterized in that the connecting means includes detent means for standardized connecting distances.

15. A diagnostic apparatus according to claim 5, characterized in that symbols which indicate the apparatus constructions having standardized connecting distances, are so arranged on one of the legs of the connecting means that the symbols become visible when the pick-up means are disposed at respective standardized connecting distances from one another.

16. A diagnostic apparatus according to claim 15, characterized in that the symbols appear in a window of the corresponding leg of the connecting means.

17. A diagnostic apparatus with an adaptor plug housing means according to claim 10, characterized in that a matching means accommodated in the adaptor plug housing means is connected in the output of the pick-up means.

18. A diagnostic apparatus according to claim 10, characterized in that the connecting means includes a handle means for plugging-in connecting contacts in a relatively tilting-free manner and simultaneously contains connecting lines to the diagnostic apparatus.

19. A diagnostic apparatus according to claim 1, characterized in that the at least two pick-up means pick up electrical measurement values from a part to be diagnosed, each pick-up means being constructed as an adaptor plug means for establishing an electrically conductive path and for picking up the measurement values from the electrically conductive path.

20. A diagnostic apparatus according to claim 1, characterized in that the connecting means is separate from the parts to be connected and enables a variable spacing of the entire pick-up means toward and away from one another.

* * * * *